US005580274A

United States Patent [19]

Tsair

[11] Patent Number: 5,580,274

[45] Date of Patent: Dec. 3, 1996

[54] MODULAR JACK STRUCTURE

[76] Inventor: Chwan-Tsay Tsair, 6 Fl. No. 176-3, Chung-Yang Rd., Sec. 3, San-Chung City, Taipei Hsien, Taiwan

[21] Appl. No.: 442,269

[22] Filed: May 16, 1995

Related U.S. Application Data

[63] Continuation-in-part of Ser. No. 184,524, Jan. 21, 1994, abandoned.

[30] Foreign Application Priority Data

Feb. 23, 1993 [CN] China ..... 93 2 03384.9

[51] Int. Cl.[6] ..... H01R 13/73

[52] U.S. Cl. ..... 439/571; 439/676

[58] Field of Search ..... 439/676

[56] References Cited

U.S. PATENT DOCUMENTS 4,556,264 12/1985 Tanaka ..... 439/676

5,178,563 1/1993 Reed ..... 439/676

*Primary Examiner*—Gary F. Paumen

*Attorney, Agent, or Firm*—Pro-Techtor Int'l

[57] ABSTRACT

An improved modular jack is provided, in which the jack structural body is made of plastics and the insertion leg is made of metal. At least a recessed portion is formed at a place where the insertion leg is intended to be mounted. The insertion leg engages with the recessed portion to thereby secured to the jack structural body. This arrangement allows the modular jack to be able to enter into soldering furnaces along with other components on the printed circuit board, such that soldering process can be completed in one pass. Assembly work is thus significantly simplified.

2 Claims, 4 Drawing Sheets

MODULAR JACK STRUCTURE

This is a continuation-in-part application of application Ser. No. 08/184,524 filed on Jan. 21, 1994, now abandoned.

BACKGROUND OF THE INVENTION

The present invention relates to modular jack structures, and more particularly, to an improved structure in the insertion legs of modular jacks.

Modular jacks are connecting devices used widely in telephones, fax machines, modems, portable computers for fast and convenience connections. They play an important role in information system integration and are indispensable components usually seen on circuit boards.

In assembly, however, the process of mounting modular jacks on circuit boards is very complicated and laborious. FIG. 1 shows a prior art modular jack A. Its structural body is made of heat-resistant plastics and having a pair of securing legs D on the bottom. The front side is open-spaced for receiving a plug. The rear side B is half-closed and provided with a lineup of grooves for accommodating pin conductors T. The insertion leg D is integrally formed with the structural body and has a split in the middle S. The head H of the insertion leg is tapered in a hook shape such that, when inserted into a hole on the circuit board, it can be fastened to the circuit board. The length d from the head H to the jack structural body is the same as the thickness of the circuit board. Thus, the length l of the pin conductors must be $l \geqq h+d$. Pin conductors are often made of expensive gold-plated phosphorous bronze, the cost is therefore high. Besides, after being mounted on circuit boards, overly extended part of the pin conductor has to trimmed off, resulting in a waste of material.

Moreover, component-mounted circuit boards have to go through soldering furnaces so as to secure each component to the circuit boards by means of soldering. The melting point for tin is around 250° C. to 280° C. If the prior art modular jack goes through the soldering furnace, its plastic-made insertion leg will be melted. For this reason, the process is divided into two stages. In the first stage, heat-resistant tapes are attached to cover holes 31 and 23 (see FIG. 7) that are used for accommodating insertion legs and pin conductors. After the soldering, these tapes are removed and then the prior art modular jack is mounted on the circuit board. Manual work is required to solder the pin conductors T to the circuit board. After that, overly extended part of the pin conductors are trimmed off.

Although heat-resistance plastics can be used to mold the jack structural body, the split S in the insertion leg may be, however, filled with chunks of tin after undergoing the soldering process. In later applications, these tin chunks may fall off onto the circuit board, causing short-circuit. Accordingly, using heat-resistant plastics still requires the attachment of tapes and does nothing good to the simplifying of the process.

Since the insertion leg in the prior art modular jack is provided with a tapered and hook-shaped head, its length is as long as 3.1–3.5 mm. This makes the length of the pin conductors larger than 4 mm, which is much greater than standard thickness (1.78 mm) of most circuit boards. This overly extended length, after the process, must be trimmed off, resulting in waste of material.

The length d from the head of the insertion leg to the bottom of the jack structural body is often fixed. However, circuit boards are often with various thicknesses, including 1.0 mm, 1.6 mm, 1.78 mm, 2.0 mm, and so on. If d is 2.0 mm, it would cause instability in the mounting of the jack. When plugs are repeatedly coupled and decoupled, the soldered connection between pin conductors and the circuit board may be subject easily to detachment. This would cause interference or interruption in the signal transmitted through the modular jack, and thus unreliability of the whole system.

In the final stage, tin-plated circuit boards must undergo a washing process. In conventional methods, liquid CFC coolant is injected on the assemblage to remove rosin oil and other chemical substances. After the ban on the use of CFC in 1993, water is used in substitute. It can be seen from FIG.1 that after the water washing process, water may stay inside the prior art modular jack. Jet gun must thus be used to remove the residual water. This add a further step in the assembling process and thus increase the cost.

SUMMARY OF THE INVENTION

It is therefore a primary objective of the present invention to provide an improved modular jack that allows great simplification of the assembling process, increases reliability, and saves cost.

It is another objective of the present invention to provide an improved modular jack that eliminate the use of jet guns to remove residual water.

In accordance with the foregoing and other objectives of the present invention, an improved modular jack is provided. The improved modular jack includes a jack structural body made of insulate material and having at least a recessed portion formed on at least one side of the jack body. At least one insertion leg made of metal and secured to the jack body by means of engaging with the recessed portion on the jack structural body.

In the first preferred embodiment of the present invention, the recessed portion is formed at one end on the bottom side of the jack structural body. The insertion leg has one end slightly bent into a hook shape slidably inserted into and clamped by the recessed portion, the insertion leg being thereafter integrated with the jack structural body by means of heating.

In the second preferred embodiment, the recessed portion has a T-shaped cross-section extended from at least one lateral side into the inside. The dimensions of the recess portion is slightly smaller than the dimensions of the insertion leg such that the insertion leg can be inserted into and clamp by the recessed portion.

In the third preferred embodiment, the recessed portion is formed on at least one lateral side of the jack structural body and has an engaging protrusion formed in the middle thereof. The insertion leg has an engaging hole formed in the middle thereof. The engaging hole is coupled with the engaging protrusion to thereby secure the insertion leg to the jack structural body.

In the fourth preferred embodiment, the recessed portion is formed on the opposite lateral sides of the jack structural body. The insertion leg is formed into a U-shape and the two free ends of the U-shaped insertion leg is slightly stepped inwards used to clamp the recessed portion.

In the fifth preferred embodiment, the insertion leg is pre-buried in a plastic mold used for forming the jack structural body to thereby integrally formed with the jack structural body.

BRIEF DESCRIPTION OF THE DRAWINGS

The present invention can be more fully understood by reading the subsequent detailed description of preferred embodiments thereof with references made to the accompanying drawings, wherein.

DETAILED DESCRIPTION OF PREFERRED EMBODIMENTS

First Preferred Embodiment

Figure 3:
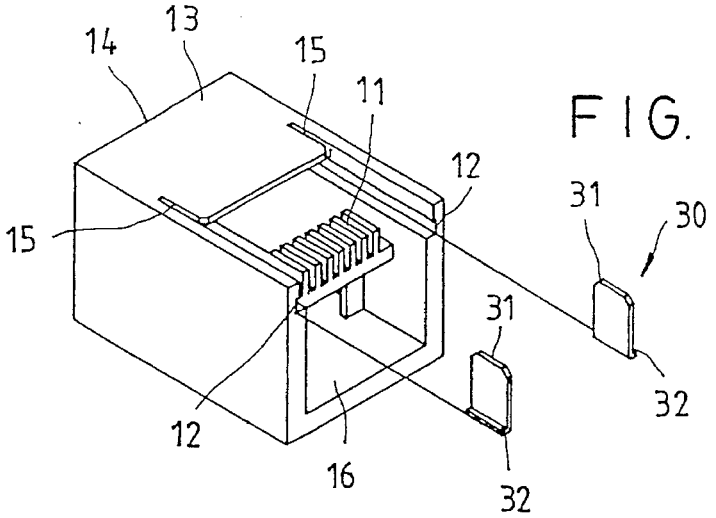
FIG.3 shows a partly exploded perspective view of a modular jack according to the first preferred embodiment of the present invention.
Figure 4:
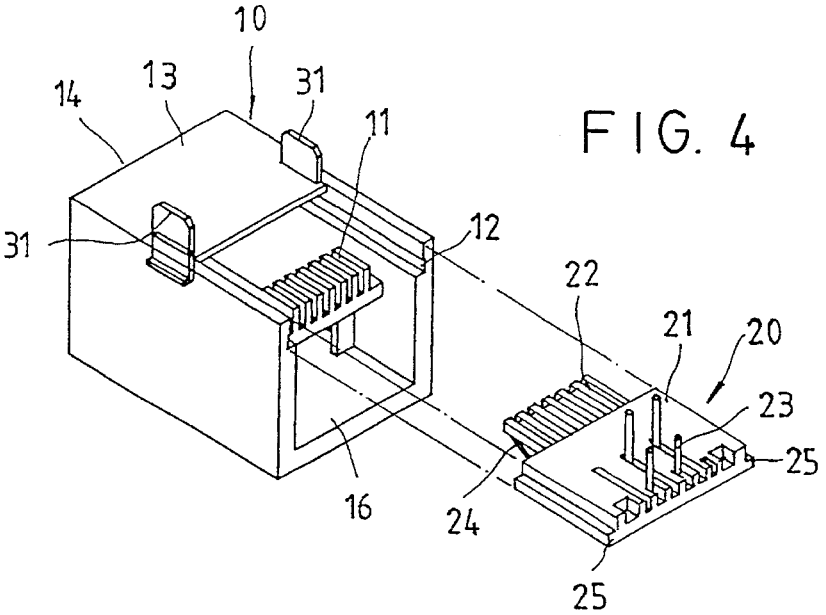
FIG.4 shows subsequent assembly work on the modular jack of FIG.3.
Figure 5:
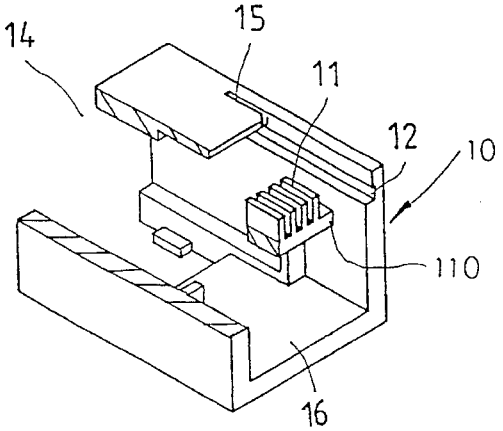
FIG.5 shows the modular jack of FIG. 3 with a part cut away to show the inside structure.

Referring to FIG.3, a modular jack 10 according to the present invention includes a front bottom plate 13, a rear bottom board 20, a throughout passage 16 and a row of spacers 11 supported by a beam 110 located between two inner walls of said body. The passage 16 has a front open end 14 and a rear open end 16(detailed structure is shown in FIG.5). In the passage, each of the two inner walls is provided with a groove 12 at the bottom extending from the rear open end 16 to the front portion of the front bottom plate 13. The end portions of the two grooves 12 further extend into the bottom plate 13, forming a pair of inlaying slits 15. The slits 15 are in connection with the grooves 12. A metal contact 30 is provided with one end bent into a L-shape. The L-shaped end of the metal contact 30 is inserted into the groove 12. When inserted in position, the body of the metal contact 30 is clamped by the slit 15. After that, a rear bottom board 20 having pin conductors 23 and a row of lines 22 is slidably inserted into the grooves 12 by means of guiding protrusions 25. If necessary, ultrasonic welding machine may be further used to weld the rear bottom board 20 and the modular jack 10.

Figure 1:
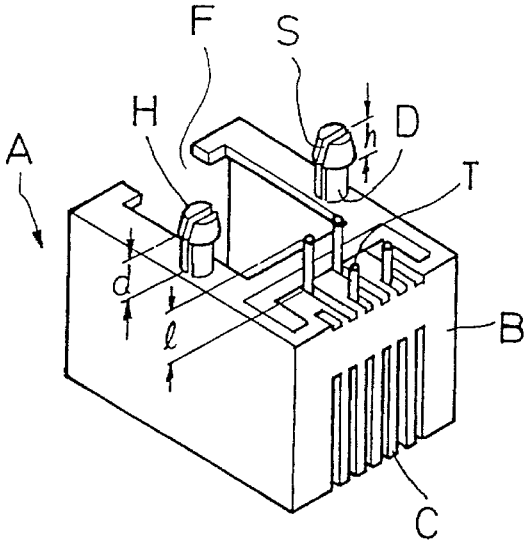
FIG. 1 (PRIOR ART)
FIG.1 shows a prior art modular jack.
Figure 2:
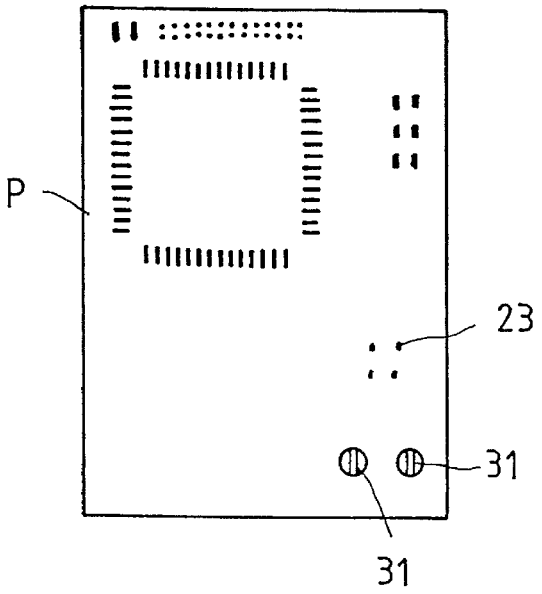
FIG. 2 (PRIOR ART)
FIG.2 shows a circuit board on which the modular jack of the present invention is mounted.

As shown in FIG.5, in the modular jack of FIG.3, the passage 16 goes straight from the front end to the rear end without any obstruction. This provision eliminates the drawback of water accumulation inside the modular jack during the washing process performed after the modular jack is mounted on PC boards. The requirement of using a jet gun for drying is also eliminated. In addition, since the modular jack according to the present invention is flat in shape instead of hook-shaped, it can be easily insertion mounted on PC boards, as demonstrated by the insertion legs 31 and pin conductors shown in FIG.1. The exposed lengths of the insertion leg 31 and the pin conductor 23 can be just slightly greater than the thickness of the PC board. This allows cost effective utilization of the pin conductor in the modular jack according to the present invention.

Since in the modular jack according to the present invention the insertion leg is made of metal, it can resist high temperature. During assembly, the modular jack can go through soldering furnaces along with those components mounted on the PC board. This eliminates laborious handwork of soldering the modular jack and attaching adhesive tapes. Consumption of copper in making pin conductors is also reduced. With the improvement of making insertion legs with metal, post processing of the PC board mounted with the modular jack according to the present invention is significantly simplified.

Second Preferred Embodiment

Figure 6:
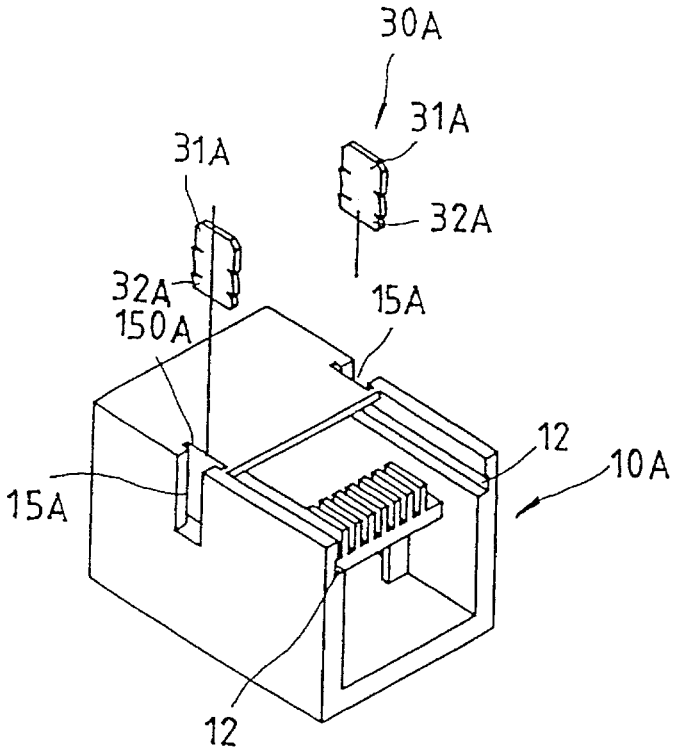
FIG.6 shows a partly exploded perspective view of a modular jack according to the second preferred embodiment of the present invention.

FIG.6 shows the second preferred embodiment of the present invention, in which a pair of grooves 15A having a T-shaped cross section are formed respectively on the opposite sides near the bottom. The inner side of each groove 15A is formed with a slit 150A, which has a slightly greater length than the width of the groove 15A. When a metal insertion leg 30A, which has a hooked end 32A (the other end 31A is identical in structure as the insertion leg of the first preferred embodiment), is inserted into the groove 15A, it can be clamped by the slit 150A to be secured to the modular jack. The effect is the same as the first preferred embodiment.

Third Preferred Embodiment

Figure 7:
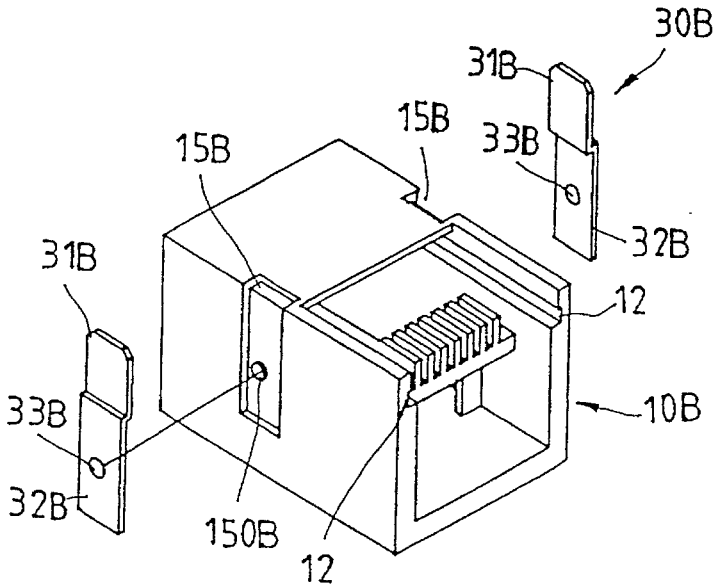
FIG.7 shows a partly exploded perspective view of a modular jack according to the third preferred embodiment of the present invention.

FIG.7 shows the third preferred embodiment of the present invention. An L-shaped recessed portion 15B is formed on each of the two opposite sides near the bottom. An engaging protrusion 150B is provided in the middle of the recessed portion 150B. The insertion leg 30B is formed into a step shape having an upper portion 31B and a bottom portion 32B. An engaging hole 33B is formed in the middle of the insertion leg 30B, which can be coupled with the engaging protrusion 150B. By means of heating sealing, the tip of the protrusion is melted, whereby the insertion leg 30B is secured to the jack 10B.

Fourth Preferred Embodiment

Figure 8:
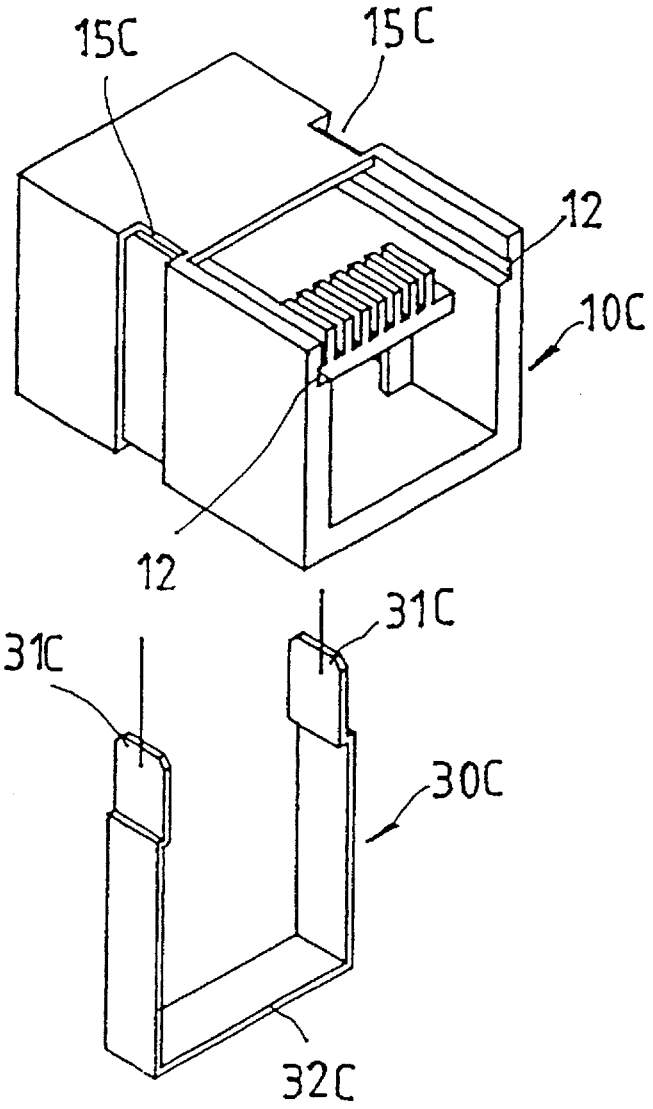
FIG.8 shows a partly exploded perspective view of a modular jack according to the fourth preferred embodiment of the present invention.

FIG.8 shows the fourth preferred embodiment of the present invention. In this modular jack, a recessed portion 15C is formed along the overall height on each of the two opposite sides. A U-shaped clamp-type insertion leg 30C clamps the two recessed portions 15C on both sides. The two free ends of the insertion leg 30C are formed in a step shape, constricting the two free ends such that the insertion leg 30C can suitably clamp the body of the modular jack. Since the clamp-type insertion leg 30C is with good elasticity, it can be secured to the modular jack by means of clamping force.

Fifth Preferred Embodiment

In the fifth preferred embodiment of the present invention, the metal member 30 can be pre-buried inside plastic molds for injection molding. When the modular jack is formed by means of injection molding, the metal member 30 is embedded partly in the body of the modular jack. Although compared to the foregoing this is a less preferred embodiment, it is still feasible with the utilization of special equipment.

SUMMARY

In summary, with the improvement of using metal-made insertion legs, the modular jack according to the present invention can significantly simply the manufacture work on the mounting of modular jacks on PC boards. The consumption of copper used in making pin conductors is significantly reduced. The securing force resulted from soldering is much larger than clamp engaging using plastic insertion legs. These advantages of the present invention provide better reliability and stability in communication circuits.

The present invention has been described hitherto with exemplary preferred embodiments. However, it is to be understood that the scope of the present invention needs not be limited to the disclosed preferred embodiments. 0n the contrary, it is intended to cover various modifications and similar arrangements within the scope defined in the following appended claims. The scope of the claims should be accorded the broadest interpretation so as to encompass all such modifications and similar arrangements.

I claim:

1. A modular jack comprising a jack structural body made of insulative material including a front bottom plate 13, a rear bottom board 20, a through passage 16 and a row of spacers 11 supported by a beam 110 located between two inner walls of said body, said through passage 16 having a front open end 14 and a rear open end 16, each of the inner walls of said passage provided with a groove 12 formed at the bottom of said jack structural body and extending from the rear open end 16 to the front portion of said front bottom plate 13, and a pair of inlaying slits 15 which are in connection with said grooves 12 and extend into the front bottom plate;

a pair of insertion legs 30 made of metal being secured to said inlaying slits 15 by means of inserting into the grooves 12;

whereby said pair of insertion legs 30 are secured into said jack structural body when said rear bottom board 20 having pin conductors 23 is slidably inserted into said grooves 12 by means of guiding protrusions 25.

2. A modular jack as claimed in claim 1, wherein each said insertion leg has one end slightly bent into a hook shape which is slidably inserted into a respective said inlaying slit, said insertion leg being thereafter integrated with said jack structural body by means of a heating operation.

* * * * *